United States Patent [19]

Easter

[11] 4,098,454

[45] Jul. 4, 1978

[54] NEWSPAPER RECEPTACLE

[76] Inventor: Robert C. Easter, 705 Little Oak, Austin, Tex. 78753

[21] Appl. No.: 739,345

[22] Filed: Nov. 8, 1976

[51] Int. Cl.[2] ..... A47G 29/12

[52] U.S. Cl. ..... 232/19; 232/54

[58] Field of Search ..... 232/15, 19, 54, 63, 232/43.4; 193/33, 34

[56] References Cited

U.S. PATENT DOCUMENTS

| | | | |
|---|---|---|---|
| 403,790 | 5/1889 | Taylor | 232/54 |
| 533,518 | 2/1895 | Witte | 232/54 |
| 752,600 | 2/1904 | Sinclair | 232/54 |
| 1,512,307 | 10/1924 | Pratt | 232/19 |
| 3,979,053 | 9/1976 | Amann | 232/43.4 |

FOREIGN PATENT DOCUMENTS

| | | | |
|---|---|---|---|
| 21,108 of | 1910 | United Kingdom | 232/54 |

*Primary Examiner*—Roy D. Frazier
*Assistant Examiner*—Peter A. Aschenbrenner
*Attorney, Agent, or Firm*—Richards, Harris & Medlock

[57] ABSTRACT

A receptacle positioned within a wall structure of a dwelling for receiving, retaining, and transmitting a newspaper or the like in a unidirectional path is disclosed. The receptacle includes an elongated chute, resilient fingers, and a first collar. The chute is comprised of an external end for receiving the newspaper into the chute, a body for retaining the newspaper within the chute, and an internal end for transmitting the newspaper from the chute. Resilient fingers extend from the inner wall of the body and converge toward the internal end of the chute for allowing unidirectional passage of the newspaper through the chute and preventing withdrawal of the newspaper from the external end. The first collar is mateable to the external end and has a plurality of elastomeric projections extending from the peripheral portion of the first collar and converging radially inward toward the center of the first collar.

2 Claims, 5 Drawing Figures

NEWSPAPER RECEPTACLE

BACKGROUND OF THE INVENTION

The present invention relates to a receptacle positioned within the wall structure for receiving, retaining, and transmitting a newspaper or the like in a unidirectional path.

Numerous industries utilize the marketing technique of hand delivery of materials such as newspapers, pamphlets, mailers, catalogs, advertisements, and similar materials to homes, apartment units, condominium units, and the like. If these materials are not delivered by the U.S. Postal Service, they may not be placed in mailboxes as placement in mailboxes of materials other than those delivered by the U.S. Postal Service is prohibited by law. Therefore, without suitable apparatus, such materials must be placed on the ground in the vicinity of a doorstep.

A major problem facing these industries which are dependent upon hand delivery of materials to apartment units, condominium units, and the like is the theft of such materials when they are left in the vicinity of a doorstep as anyone may readily pick up the materials. Moreover, materials which are delivered to such units often stack up over a period of time without being picked up by the occupant, indicating to a potential burglar that the occupant is away from the unit. Had these materials been hidden from open view, the burglar would not be as likely to break and enter into the unit.

One of the industries which has contended with these problems for many years is the newspaper industry. Specifically, if a newspaper is left in the vicinity of the doorstep, it may be readily stolen by anyone passing by. Moreover, if newspapers are left stacked up, this is an indication to a potential home burglar that the occupant is away.

There are known and utilized by the newspaper industry devices which have the capability of receiving and storing newspapers. However, these devices often create more problems than they solve. For instance, there is known to the art a newspaper container which is normally attached to the exterior wall of a unit. Usually the container is designed to hold only one or two copies of newspapers; thus when an occupant is away from the unit, additional copies of newspapers must be stacked upon the ground in the vicinity of the container. This enables the burglar to know when the occupant is away from the unit, and chances of a burglary are increased. Moreover, when newspapers are stored in such containers, they may be easily stolen therefrom.

Also known to this art is the use of racks for placement near mailboxes in apartment or condominium units. Often the occupant of such a unit is provided with a key to the rack and upon unlocking the rack each day one may pick up their copy of the newspaper. This device has several disadvantages such as each day one must use a key which may be lost and must be replaced. Further, the newspaper rack is often located some distance away from the apartment or condominium unit; thus, it is not very handy to the occupant especially if one is handicapped.

The present invention solves these and other problems by providing means for receiving, retaining, and transmitting newspapers or the like inside a dwelling such as a house or an apartment or condominium unit. The receptacle comprising the present invention is constructed so as to obstruct the view of a person looking through the receptacle. Moreover, once the newspaper is inside the dwelling, it is impossible to determine if the occupant is at home. Finally, the present invention is designed to allow the newspaper to be received, retained, and transmitted in a unidirectional path into the dwelling while preventing the newspaper from being brought back through the receiving end.

SUMMARY OF THE INVENTION

In accordance with the present invention, a receptacle positioned within a wall structure of a dwelling for receiving, retaining, and transmitting a newspaper or the like in a unidirectional path, is disclosed and includes an elongated chute, resilient fingers, and a first collar. The chute is comprised of an external end for receiving the newspaper into the chute, a body for retaining the newspaper within the chute, and an internal end for transmitting the newspaper from the chute. The resilient fingers extend from the inner wall of the body and converge toward the internal end of the chute for allowing passage of the newspaper through the chute and preventing withdrawal of the newspaper from the external end. The first collar is mateable to the external end and has a plurality of elastomeric projections extending from the peripheral portion of the first collar and converging radially inward toward the center of the first collar.

DETAILED DESCRIPTION OF THE DRAWINGS

DETAILED DESCRIPTION OF THE INVENTION

Figure 1:
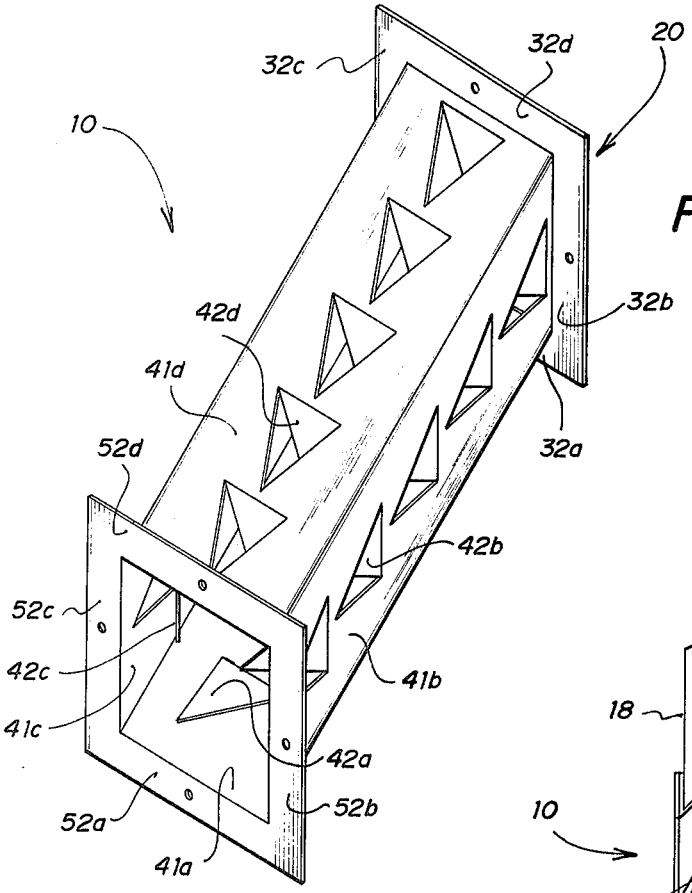
FIG. 1 is a perspective view of the present invention.
Figure 2:
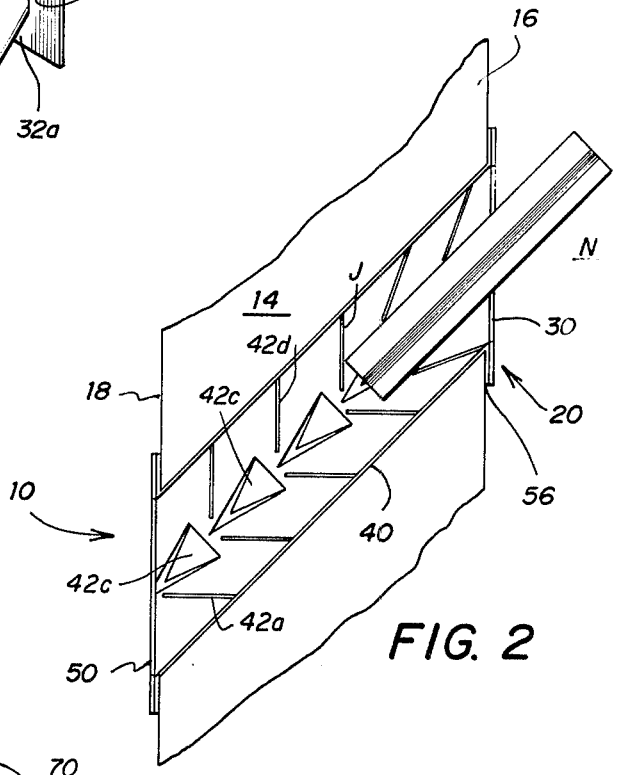
FIG. 2 is a sectional view of the present invention positioned within a wall structure.

Referring now to FIGS. 1 and 2, the receptacle of the present invention is generally referred to as reference numeral 10. Normally positioned within a wall 14 of a dwelling such as a home or an apartment or condominium unit, receptacle 10 is designed to receive, retain, and transmit in a unidirectional path a newspaper or the like. Receptacle 10 is normally positioned within wall 14 while the dwelling is under construction, but may be inserted into an aperture formed in the wall of an already existing dwelling. In positioning receptacle 10 within wall 14, the aperture is preferably designed so that an interference fit is provided between receptacle 10 and the remaining portion of wall 14.

While receptacle 10 may be constructed from numerous light weight materials including aluminum or steel, the preferred material is a plastic material. Construction of receptacle 10 from a plastic material enables the present invention to be produced at low cost as well as providing a durable device.

Figure 4:
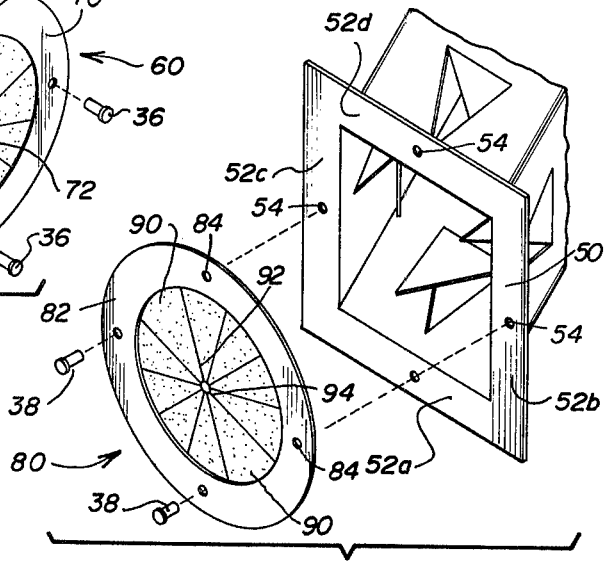
FIG. 4 is a perspective view of the internal end of the receptacle and the second collar.

Receptacle 10 primarily comprises an elongated chute 20, resilient fingers 42*a–d*, a first collar 60, and a second collar 80 (FIG. 4). These elements of receptacle 10 cooperate together to enable receptacle 10 to receive, retain, and transmit a newspaper or the like in a unidirectional path.

Chute 20 of receptacle 10 may have a round, square, rectangular, octagonal, or other multi-sided cross section. In the preferred embodiment, chute 20 has a square cross section as the aperture in wall 14 into which chute 20 fits may be easily formed into a square shape. Chute 20 may be constructed in any variety of lengths, thus accommodating various widths of walls. In the preferred embodiment, chute 20 has a length of approximately 17 inches. Finally, chute 20 should have a cross sectional diameter sufficiently large to accommodate thick newspapers such as those published on Sundays. A diameter of from about four to about six inches will normally accommodate thick newspapers.

Figure 3:
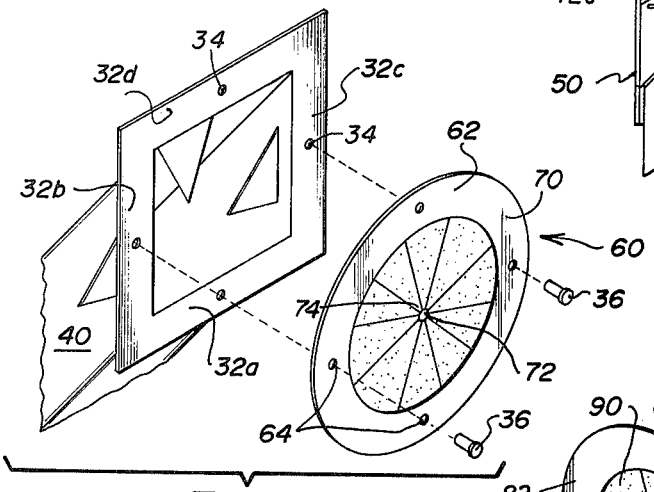
FIG. 3 is a perspective view of the external end of the receptacle and the first collar.

Chute 20 includes an external end 30, body 40, and an internal end 50 which provide means for receiving, passing, and transmitting newspaper N through chute means 20. External end 30 of chute means 20 is usually positioned relatively flush with outside portion 16 of wall structure 14. In the preferred embodiment, and as shown in FIG. 3, external end 30 is a flanged member having flange portions 32*a–d*. If body 40 is positioned within wall 14 at a 45 degree angle relative to the ground, flange portion 32*a* extends from wall 41*a* of body 40 at a 45° angle, flange portions 32*b* and 32*c* extend from walls 41*b* and 41*c* of body 40 at a 90° angle, and flange portion 32*d* extends from wall 41*d* of body 40 at a 135° angle. The length of body 40 should be designed so that flange portions 32*a–d* have an interference fit with outside portion 16 of wall 14. Each of the flange portions 32*a–d* have apertures 34 into which screws 36 may be inserted to hold first collar means 60 which is hereinafter more fully described. Thus, external end 30 is designed to receive newspaper N and also to have an interference fit with wall 14.

Figure 5:
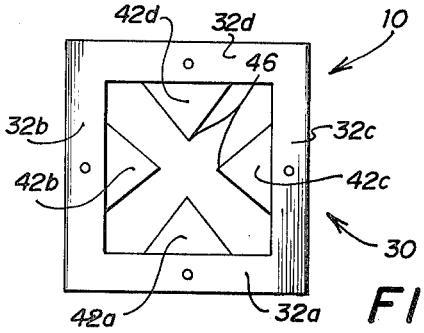
FIG. 5 is an end view of the external end of the present invention.

Referring now to FIGS. 1, 2, and 5, body 40 of chute 20 is depicted and is utilized for passing newspaper N within chute 20. Body 40 extends between external end 30 and interior end 50 and includes walls 41*a–d* and a plurality of resilient fingers 42*a–d* which respectively extend from the inner portion of walls 41*a–d* of body 40. Fingers 42*a–d* provide the retaining means of the present invention whereby newspaper N may be received by external end 30 and upon passage into body 40, fingers 42*a–d* may retain newspaper N within body 40. Moreover, fingers 42*a–d* impede any attempt to withdraw newspaper N from the external end, thus imparting an unidirectional characteristic to the present invention.

Fingers 42*a–d* are normally formed by stamping out a triangular shaped portion on each of walls 41*a–d* of body 40. Fingers 42*a–d* are usually bent from wall 41*a–d* of body 40 so that at each juncture J of fingers 42*a–d* and inner walls 41*a–d*, there is formed an angle from about 30° to about 60°. Ends 46 of fingers 42*a–d* are designed to converge toward internal end 50 of chute 20 and permit passage of newspaper N through chute 20 while preventing withdrawal of newspaper N from external end 30. In this manner, a newspaper N received by receptacle 10 may be retained within body 40 by fingers 42*a–d*, yet if one attempts to withdraw newspaper N from body 40, this will be practically impossible because fingers 42*a–d* prohibit newspaper N from being withdrawn toward the external end 30.

As an integral part of chute 20 and particularly body 40, fingers 42*a–d* are constructed from a plastic or light weight aluminum or steel material which has elastomeric properties. If fingers 42*a–d* are constructed from an elastomeric material which is stiff or rigid, newspaper N will be retained more readily within body 40 of receptacle 10. However, if fingers 42*a–d* are constructed from an elastomeric material wherein ends 46 are easily bent back toward the inner portions of walls 41*a–d* of body 40, newspaper N normally will pass directly through body 40 and be transmitted through internal end 50 of chute 20 without having been retained within body 40 by fingers 42*a–d*. Thus, depending upon the elastomeric properties of the material utilized for construction of fingers 42*a–d*, and the force used by the person inserting newspaper N into receptacle 10, newspaper N may or may not be retained within receptacle 10.

Finally, once newspaper N is received and transmitted into body 40 of receptacle 10, newspaper 10 may not be withdrawn from external end 30. The unique design of fingers 42*a–d* provides a unidirectional feature which permits newspaper N to be withdrawn from receptacle 10 only through internal end 50. Any attempt to withdraw newspaper N back through external end 30 will be thwarted, since opposed fingers 42*a* and 42*c* as well as opposed fingers 42*b* and 42*d* will be drawn towards each other and the distance between opposed ends 46 is reduced. At some point, depending upon the cross sectional diameter of body 40 and the elastomeric properties of fingers 42*a–d*, opposed fingers cannot be drawn any further toward each other or toward external end 30. At this point, the angle between each of fingers 42*a–d* and the inner portion of wall 41*a–d* is usually from about 50° to about 80°. As soon as it is discovered that one cannot remove newspaper N from external end 30 and the attempt ceases, the plurality of fingers 42*a–d* return to their original position and newspaper N may be transmitted from receptacle 10 through internal end 50. Thus, body 40 and particularly fingers 42*a–d* are provided to retain newspaper N within body 40 while thwarting attempts to withdraw newspaper N through external end 30 but permitting withdrawal of newspaper N through internal end 50.

Referring now to FIG. 4, internal end 50 of receptacle 10 is provided for transmitting newspaper N from the chute 20 to the inside of the dwelling. Internal end 50 of chute 20 is usually positioned relatively flush with inside portion 18 of wall 14. In the preferred embodiment internal end 50 is a flanged member having flange portions 52*a–d*. If body 40 is positioned within wall 14 at a 45° angle relative to the ground, flange portion 52*a* extends from wall 41*a* of body 40 at a 135° angle, flange portions 52*b* and 52*c* extend from walls 41*b* and 41*c* of body 40 at a 90° angle, and flange portion 52*d* extends from wall 41*d* of body 40 at a 45° angle. The length of chute 40 is designed so that flange portions 52*a–d* have an interference fit with inside portion 18 of wall 14. Each of the flange portions 52*a–d* have apertures 54 into which screws 36 may be inserted to hold second collar 80 which is hereinafter more fully described.

Normally, when receptacle 10 is placed within wall 14, external end 30 is elevated in relation to internal end 50 as this placement is desirable since it allows gravity to aid in the passage of newspaper N through body means 40. Furthermore, external end 50 should be positioned within wall 14 so that when newspaper N is transmitted from chute 20, it will fall only a few feet to the floor of the dwelling. In the preferred embodiment, internal end 50 is positioned about two or three feet from the floor of the unit.

Thus, it may be seen that the present invention is designed to receive, retain, and transmit newspaper N in a unidirectional path utilizing the disclosed chute 20 which includes external end 30 for receiving the newspaper, body 40 for passage of newspaper N within chute 20, and internal end 50 for removing the newspaper N from the chute 20. Body 40 further includes fingers 42*a–d* which may retain newspaper N within chute 20, but prevent withdrawal of newspaper N from external end 30 while permitting transmission of newspaper N through internal end 50.

Receptacle 10 further includes first collar 60 which is depicted in FIG. 3. First collar 60 is provided for mating with external end 30 and aids with fingers 42*a–d* in obstructing the view of one attempting to look through the length of chute 20. First collar 60 may be constructed from similar materials as used for chute 20 and includes peripheral portion 62 having apertures 64 through which screws 36 may be inserted. As seen in FIG. 3, first collar 60 is mateable with external end 30 at its flange portions 32*a–d* and is secured thereto by screws 36. It is to be understood that any securing means such as bolts and nuts may be utilized to secure first collar 60 to external end 30. Also, receptacle 10 may be constructed whereby first collar 60 is adhesively secured to external end 30 by a suitable adhesive or first collar 60 is molded to external end 30 in suitable molding apparatus.

First collar 60 further includes a plurality of elastomeric projections 70 which converge radially inward toward the center of the first collar 60. In the preferred embodiment, collar projections 70 are pie-shaped and ends 72 of collar projections 70 are either contiguous at the center portion of first collar 60 or form a small opening such as opening 74. Projections 70 are designed to be readily capable of being drawn into chute 20 when newspaper N is inserted into receptacle 10. Moreover, since projections 70 converge at or near the center of first collar 60, a person's view in attempting to look into the dwelling through receptacle 10 is obstructed. Also, projections 70 impede rain, snow, and the like from entering into the dwelling through receptacle 10.

Receptacle 10 may further include a second collar 80 which is mateable to internal end 50 of chute 20. When mated to internal end 50, second collar 80 may be viewed from the inside of the dwelling and thus provides a pleasingly aesthetic member covering the internal end 50 and body 40 of receptacle 10. Addition of second collar 80 aids with first collar 60 and fingers 42*a–d* to obstruct the view of a person attempting to look through receptacle 10 and view the inside of the dwelling.

Second collar 80 may be constructed similar to first collar 60. As seen in FIG. 4, second collar 80 may be constructed from similar materials as used for chute 20 and includes peripheral portion 82 having aperture 84 through which screws 38 may be inserted. As seen in FIG. 4, second collar 80 is mateable with internal end 50 at its flange portions 52*a–d* and is secured thereto by screws 38. It is to be understood that any securing means such as bolts and nuts may be utilized to secure second collar 80 to internal end 50. Second collar 80 may be adhesively secured or molded to internal end 50, similar to the description of first collar 60 being secured to external end 30.

Second collar 80 further includes a plurality of elastomeric projections 90 which converge radially inward toward the center of the second collar 80. Projections 90 are designed to be readily capable of being drawn away from chute 20 when newspaper N is transmitted through internal end 50 of receptacle 10. In the preferred embodiment, collar projections 90 are pie-shaped and ends 92 of collar projections 90 are either contiguous at the center portion of second collar 80 or form a small opening such as opening 94.

Thus, there is provided a receptacle positioned within a wall structure for receiving, retaining, and transmitting a newspaper or the like in a unidirectional path. The present invention provides means for permitting ready insertion of a newspaper into a dwelling without allowing outside observation of the inside of the dwelling or the newspaper either retained within the receptacle or transmitted into the dwelling. Moreover, the present invention features unidirectional entry in which a newspaper may not be removed from the external end after the newspaper has been received by the receptacle. Finally, the newspaper may be retained by the fingers of the body until one desires to remove the newspaper from the internal end or the receptacle may be designed so as to permit the newspaper to pass through the body and into the dwelling without being retained thereby.

It is apparent that there has been provided, in accordance with the invention, a receptacle that satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A receptacle in a wall structure for receiving, retaining, and transmitting in a unidirectional path a newspaper or the like, comprising:

(a) an elongated chute comprising:

(i) an external end for receiving the newspaper or the like into the chute;

(ii) a unitary body including top, bottom and opposed side walls for retaining the newspaper or the like within the chute; and (iii) an internal end for transmitting the newspaper or the like from the chute, the external end of the chute being elevated in relation to the internal end of the chute when positioned in the wall structure;

(b) resilient fingers extending from the walls of the body and converging downwardly toward the internal end of the chute and capable of expansion or contraction for allowing passage of newspapers or the like through the body of the chute while preventing withdrawal of newspapers or the like from the external end of the chute;

(c) a first collar means mateable to the external end of the chute and having a plurality of radial extending slots to define a plurality of resilient fingers perpendicularly extending from the peripheral portion of the first collar means and converging radially inwardly toward the center of the first collar means, the fingers being mateable to define a coplanar configuration, such that the first collar means provides a weatherproof closure for the external end of the chute, the fingers being yieldably drawn inwardly into the chute in the direction of an inserted newspaper or the like into the chute and the fingers returning to the coplanar configuration after passage of the newspaper or the like through the first collar means; and (d) a second collar means mateable to the internal end of the chute and having a plurality of radial extending slots to define a plurality of resilient fingers perpendicularly extending from the peripheral portion of the second collar means and converging radially inwardly toward the center of the second collar means, the fingers being mateable to define a coplanar configuration, such that the second collar means provides a closure for the internal end of the chute, the fingers being yieldably drawn outwardly of the chute in the direction of an inserted newspaper or the like as the newspaper or the like exits from the chute and the fingers returning to the coplanar configuration after passage of the newspaper or the like through the second collar means.

2. The receptacle of claim 1 wherein the chute has a rectangular or octagonal cross section.

* * * * *